US006447349B1

(12) United States Patent
Fadeley et al.

(10) Patent No.: US 6,447,349 B1
(45) **Date of Patent: *Sep. 10, 2002**

(54) STICK CONTROL SYSTEM FOR WATERJET BOATS

(75) Inventors: Kenton D. Fadeley, Solomons; Shepard W. McKenney, Drayden, both of MD (US); Thomas M. Serrao, Orrington, ME (US)

(73) Assignee: The Talaria Company, LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,173

(22) Filed: Jul. 17, 2000

Related U.S. Application Data

(63) Continuation of application No. 09/146,596, filed on Sep. 3, 1998.

(51) Int. Cl.[7] ..... B63H 11/11
(52) U.S. Cl. ..... 440/41; 114/151
(58) Field of Search ..... 440/38, 40, 41, 440/42; 114/150, 151

(56) References Cited

U.S. PATENT DOCUMENTS

| | | | | |
|---|---|---|---|---|
| 3,409,252 A | * 11/1968 | Miller | 244/237 |
| 3,675,611 A | 7/1972 | Glass | |
| 3,937,172 A | 2/1976 | Castoldi | |
| 3,942,464 A | 3/1976 | Schoell | |
| 3,976,023 A | 8/1976 | Noguchi et al. | 114/144 E |
| 4,026,235 A | 5/1977 | Woodfill | |
| 4,047,494 A | 9/1977 | Scott | |
| 4,214,544 A | 7/1980 | Dashew et al. | 114/151 |
| 4,220,111 A | 9/1980 | Krautkremer et al. | 440/53 |
| 4,223,630 A | 9/1980 | Kenney | 440/41 |
| 4,417,879 A | 11/1983 | Kulischenko | 440/62 |

(List continued on next page.)

FOREIGN PATENT DOCUMENTS

| | | |
|---|---|---|
| EP | 0 035 859 | 9/1981 |
| GB | 1561281 | 2/1980 |
| JP | 406024388 | 2/1994 |

OTHER PUBLICATIONS

Altantic Control Systems, Inc., Jetstic Dual Drive System.
Servo Commander—Single Drive Brochure, SKT/Styr–KontrollTeknik AB; BN Marin Elektronik, Sweden (1996).
Servo Commander—Dual Drive Brochure, SKT/Styr–Kontroll Teknik AB; BN Marin Elektronik, Sweden (1996).

*Primary Examiner*—S. Joseph Morano
*Assistant Examiner*—Andrew Wright
(74) *Attorney, Agent, or Firm*—Fish & Richardson P.C.

(57) ABSTRACT

A waterjet-driven boat has a reversing bucket for controlling forward/reverse thrust and a rotatable nozzle for controlling sideward forces. A bucket position sensor is connected to the reversing bucket, and the bucket is controlled using the output of the position sensor to enable the bucket to be automatically moved to a neutral thrust position. Similarly, a nozzle position sensor is connected to the nozzle, and the nozzle is controlled using the output of the nozzle position sensor so that the nozzle may be automatically returned to a zero sideward force position. A joystick with two axes of motion may be used to control both the bucket and the nozzle. The joystick has built-in centering forces that automatically return it to a neutral position, causing both the bucket and nozzle to return to their neutral positions.

10 Claims, 5 Drawing Sheets

U.S. PATENT DOCUMENTS

| | | | | | |
|---|---|---|---|---|---|
| 4,509,923 | A | | 4/1985 | Turnbull | 440/43 |
| 4,519,335 | A | | 5/1985 | Krautkremer et al. | 114/144 R |
| 4,691,659 | A | | 9/1987 | Ito et al. | 114/144 R |
| 4,747,359 | A | | 5/1988 | Ueno | 114/144 B |
| 4,748,928 | A | | 6/1988 | Nakamura | 114/144 R |
| 4,915,049 | A | | 4/1990 | Nakamura | 114/144 R |
| 4,962,717 | A | | 10/1990 | Tsumiyama | 114/144 R |
| 4,992,065 | A | | 2/1991 | Torneman et al. | 440/41 |
| 4,996,937 | A | | 3/1991 | Niina et al. | 114/144 R |
| 5,031,561 | A | | 7/1991 | Nilsson | 114/144 R |
| 5,050,518 | A | | 9/1991 | Okita | 114/144 A |
| 5,090,929 | A | | 2/1992 | Rieben | 440/40 |
| 5,107,424 | A | | 4/1992 | Bird et al. | |
| 5,116,180 | A | * | 5/1992 | Fung et al. | 414/5 |
| 5,129,846 | A | | 7/1992 | Dimijian | 440/40 |
| 5,235,927 | A | | 8/1993 | Singh et al. | 114/144 E |
| 5,240,444 | A | | 8/1993 | Kobayashi et al. | 440/41 |
| 5,344,344 | A | | 9/1994 | Forsstrom | 440/41 |
| 5,361,717 | A | | 11/1994 | Kobayashi | 114/361 |
| 5,362,269 | A | | 11/1994 | Leach | 441/65 |
| 5,395,272 | A | | 3/1995 | Smith | 440/42 |
| 5,540,174 | A | | 7/1996 | Kishi et al. | 114/291 |
| 5,603,644 | A | | 2/1997 | Kobayashi et al. | 440/86 |
| 5,664,978 | A | | 9/1997 | Howe | 440/75 |
| 5,707,264 | A | | 1/1998 | Kobayashi et al. | 440/86 |
| 6,142,841 | A | | 11/2000 | Alexander, Jr. et al. | |
| 6,230,642 | B1 | | 5/2001 | McKenney et al. | |
| 6,234,853 | B1 | | 5/2001 | Lanyi et al. | |

* cited by examiner

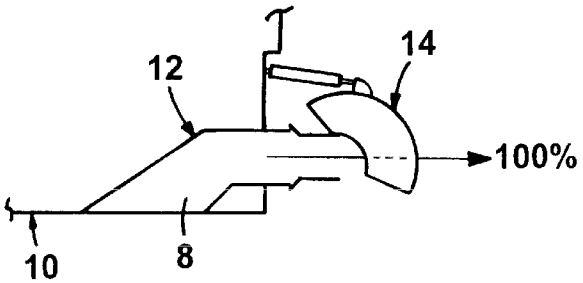
PRIOR ART
FIG. 2A
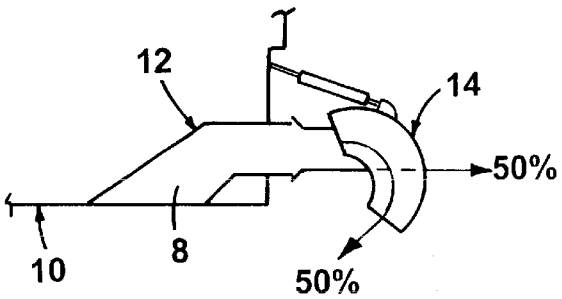
PRIOR ART
FIG. 2B
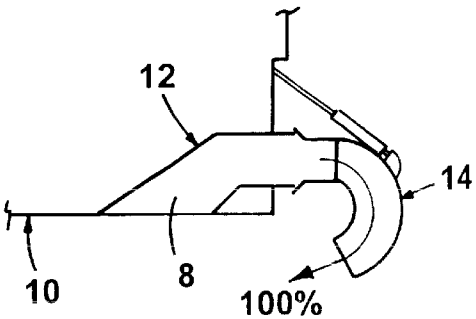
PRIOR ART
FIG. 2C
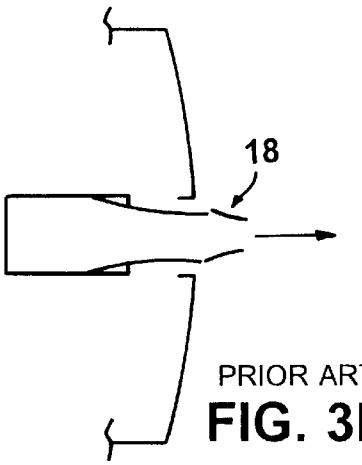
PRIOR ART
FIG. 3A
PRIOR ART
FIG. 3B
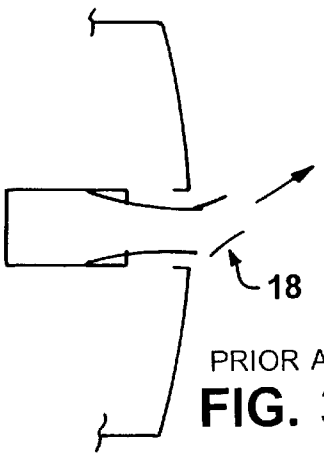
PRIOR ART
FIG. 3C

STICK CONTROL SYSTEM FOR WATERJET BOATS

CROSS-REFERENCE TO RELATED APPLICATIONS

This application is a continuation application of and claims priority to U.S. application Ser. No. 09/146,596, filed on Sep. 3, 1998.

BACKGROUND OF THE INVENTION

The invention relates to steering and thrust control systems for waterjet driven boats.

With a waterjet drive, seawater is drawn in through the bottom of the boat and ejected in a stream out the back. The reaction to this movement of water is the propulsive force that moves the boat. Near the back of the stream is a nozzle, which serves two functions. It accelerates the stream by reducing its diameter, and it can be turned from side to side to deflect the exiting stream to apply a component of side force on the aft part of the boat. The nozzle is to a jet what a rudder is to a boat equipped with conventional propellers. Both are typically connected to a steering wheel.

The aftmost portion of the jet, just behind the nozzle, is a device called a reversing bucket. Its function is to allow the operator to reverse some or all of the stream in order to stop or back up the boat. In normal underway operation the bucket is elevated above the stream and has no effect. When reduced forward thrust is desired the bucket can be lowered into the stream, forcing a portion of the flow through curved channels until it exits in a forward and slightly downward direction. When roughly half the stream is still streaming aft below the bucket and half is being reversed to a more forward direction (the neutral bucket; position), an approximate balance point can be reached that results in approximately no forward or aft thrust on the boat. If the bucket is lowered to the full down position, nearly all the thrust is reversed and the boat should begin moving in reverse. The particular design of some reverse buckets (e.g., Hamilton waterjets), and the way the bucket interacts with the nozzle, permits a net thrust in any direction in the plane of the water's surface. Side to side force is adjusted by nozzle position, and forward or aft force by bucket position.

A waterjet is either engaged and pumping water or disengaged and not pumping water. It does not ordinarily have a forward and reverse in the same manner as a conventional propeller. A transmission with reverse gear can be provided as a means of allowing the engine to run without engaging the jet and to allow for backflushing that results from reversing the drive shaft to the jet to clear an obstruction that may have been drawn against the jet inlet. Actual reverse thrust is accomplished with the jet engaged in the forward direction and the bucket lowered, similar in concept to the reversing arrangement on aviation jet engines.

Waterjet drives have numerous advantages, e.g., low draft, reduced noise, improved high-speed maneuverability. But they can make a boat difficult to control at slow speeds in tight quarters (e.g., when docking). The reason for this is that, heretofore, there has been no simple way to achieve zero thrust or zero side force. In a conventionally powered boat, zero thrust and zero side force are easily achieved, simply by putting the transmission into neutral, thereby bringing the propeller to rest. But with a waterjet, the only way to achieve zero thrust is to move the bucket to a position at which the net of the forward and reverse portions of the jet is balanced. That position can only be chosen approximately. It takes considerable training and experience for an operator to acquire a sense of what the waterjet drive is doing, to allow successful slow speed operation.

Waterjet drives also behave differently in reverse from propeller driven craft. Because the flow of water through the jet is always in one direction, deflection of the stream results in the same sideward force regardless of whether the boat is moving forward or in reverse. This is in contrast to a conventional rudder, whose effect on the stern of a boat is reversed depending on the direction of travel through the water. This difference in steering in reverse presents difficulties for new operators, who anticipate that steering direction will change when the boat is backing up.

To control movement of the bow of a boat, some boats are equipped with bowthrusters. Such a thruster is often installed in a tube that runs from side to side at the bow below the waterline. In the middle of this tube is a propeller that can thrust either way by reversing rotation. In smaller boats, this propeller is usually driven by an electric motor. The combination of waterjet and bowthruster can give a boat extraordinary maneuverability. Movement in any direction in the plane of the water's surface is possible, even directly sideways. But, unfortunately, the operator is typically required to skillfully coordinate different controls simultaneously to take full advantage of this maneuverability. E.g., a foot pedal or left/right deflection of a hand-operated lever may be used to control the bowthruster, a steering wheel, to control the rear nozzle, and a throttle lever, to control speed.

Some very large waterjet driven ships have solved the zero thrust difficulty by controlling the waterjet with an inertial control system that senses applied thrust (e.g., using accelerometers), and adjusts the waterjet bucket position until a desired thrust level is achieved. When the operator desires a zero thrust level, the control system adjusts the bucket position until the inertial sensors detect zero applied thrust. This solution is too expensive for small boats (i.e., boats 75 feet or less in length).

SUMMARY OF THE INVENTION

We have discovered an improved method for controlling a waterjet drive that overcomes prior difficulties with low-speed handling of boats with waterjet drives. The invention has numerous advantages. It allows a relatively unskilled operator of a jet boat to quickly master low-speed control of the boat. In preferred embodiments, control of reversing bucket, nozzle, and bowthruster are combined in a single joystick in a manner that is surprisingly easy for an unskilled operator to master. By having the joystick return to a neutral position corresponding to balanced, neutral fore/aft thrust (and preferably also neutral port/starboard nozzle thrust), it is possible for the operator to reliably put the boat in neutral, something not readily possible in conventional waterjet boats. This control arrangement also overcomes the problem that waterjet drives tend to behave differently in reverse than conventional propeller driven craft.

In a first aspect, the invention features providing a bucket position sensor connected to the reversing bucket of a waterjet drive, and controlling the bucket in response to an output of the position sensor to enable the bucket to be automatically moved to a neutral thrust position.

One or more of the following features may be incorporated in preferred embodiments of the invention:

A joystick may be configured so that when the joystick is placed in its neutral position the drive mechanism automatically moves the reversing bucket to the neutral thrust position.

A centering force can be provided in the joystick so that when released by the operator, the joystick returns to its neutral position and the thrust is returned to neutral.

The joystick can be configured so that rotation (or twist) of the joystick about a generally vertical axis controls rotation of the waterjet nozzle about its axis.

A nozzle position sensor may be connected to the nozzle, and provide control circuitry with a measurement of the position of the waterjet nozzle.

The joystick may have a centering torque that returns the stick to a zero rotation position when released by the operator. The control circuitry may be configured with the nozzle position sensor so that releasing the joystick and allowing it to return to the zero rotation position automatically causes the nozzle to return to a zero sideward force position.

The automatic zeroing of sideward force can be combined with the automatic zeroing of forward/reverse thrust, so that when the operator releases the joystick all propulsion forces on the boat are brought to zero.

A bowthruster can be controlled by left/right movement of the same joystick, so that leftward movement of the joystick produces a leftward movement of the bow of the boat and rightward movement of the joystick produces rightward movement of the bow.

The bucket position sensor, joystick, and control circuitry may be configured to provide at least two modes of operation, a first mode in which a follow-up relationship exists between forward/aft movement of the stick control member and up/down movement of the reversing bucket, and a second mode in which a non-follow-up relationship exists between forward/aft movement of the stick control member and up/down movement of the reversing bucket.

The nozzle position sensor, joystick, and control circuitry may be configured to provide a follow-up relationship between the rotation of the stick control member and rotation of the nozzle.

The electrical circuitry may be configured to provide both a docking mode and a power steer mode of operation, wherein in the docking mode of operation, the bucket position sensor, nozzle position sensor, and stick control member are configured so that both bucket position control and nozzle position control have a follow-up relationship to the respective movements of the stick control member, and wherein in the power steer mode of operation, the bucket position sensor, nozzle position sensor, and stick control member are configured so that bucket position control is non-follow-up and nozzle position control is follow-up.

In the power steer mode of operation, the electrical circuitry and stick control member may be configured so that rotational movement of the stick member produces less rotation of the nozzle than in the docking mode.

A trim adjustment control may be provided to permit the operator to adjust an offset between nozzle position and joystick rotation.

Hydraulic cylinders may be used to position the bucket and/or nozzle, and the:components may be configured to provide two speeds of movement of the hydraulic cylinder, a high-speed movement for use when the cylinder is more than a predetermined distance away from the position prescribed by the-control circuitry, and a low speed movement for use when the cylinder is less than the predetermined distance.

Other features and advantages of the invention will be apparent from the following description of preferred embodiments, and from the claims.

BRIEF DESCRIPTION OF THE DRAWING

FIGS. 2A, 2B, and 2C are enlarged, diagrammatic, elevation views of the waterjet and reversing bucket of FIG. 1A, showing the bucket in three different positions.

FIGS. 3A–3F are enlarged, diagrammatic, plan views of the waterjet and reversing bucket of FIG. 1B, showing the nozzle in three different positions for the case of the reversing bucket being all of the way up (maximum forward thrust; FIGS. 3A–3C) and all of the way down (maximum reverse thrust; FIGS. 3D–F).

DESCRIPTION OF THE PREFERRED EMBODIMENTS

Figure 1A:
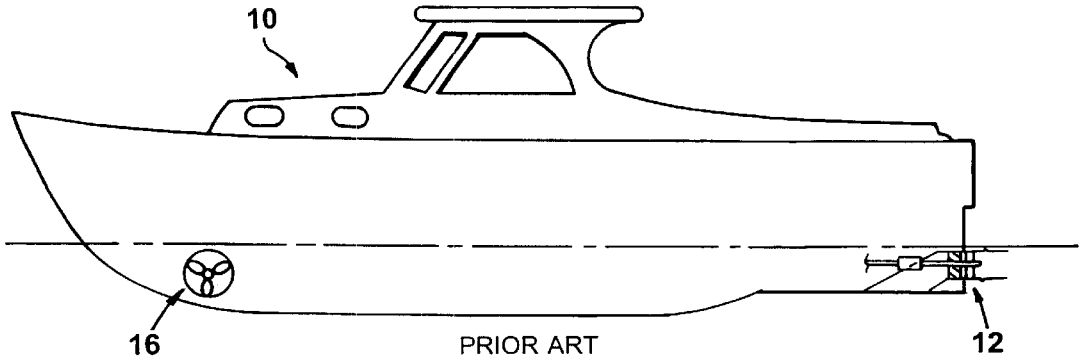
PRIOR ART FIG. 1A
FIG. 1A is an elevation view of a prior art boat equipped with a waterjet drive and bowthruster.
Figure 1B:
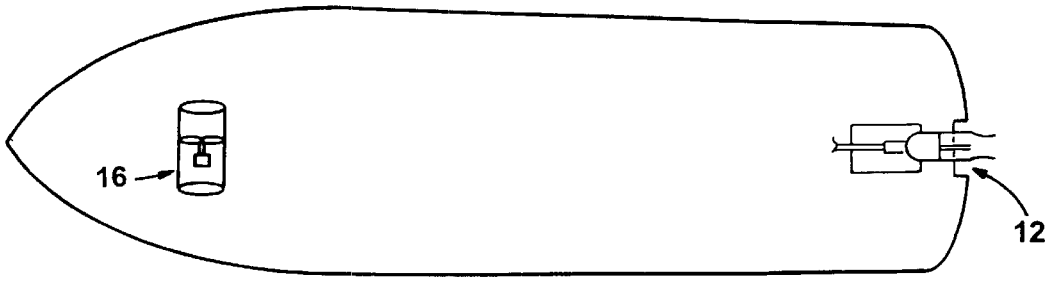
PRIOR ART FIG. 1B
FIG. 1B is a plan view of the same prior art boat.

A boat 10 with a waterjet drive 12 and bowthruster 16 is shown in FIGS. 1A and 1B. Water enters the drive through inlet 8, and exits through nozzle 18.

FIGS. 2A–2C are enlarged views of the waterjet drive 12, showing the reversing bucket 14 in full forward (FIG. 2A), approximately neutral (FIG. 2B), and full reverse (FIG. 2C) positions.

FIGS. 3A–3C show the waterjet nozzle 18 in three different angular positions (the nozzle rotates about a generally vertical axis) for the case in which the reversing bucket is all of the way up: left sideways thrust (FIG. 3A), approximately neutral thrust (FIG. 3B), and right sideways thrust (FIG. 3C). When the bucket is all of the way up, the bucket is out of the way of the nozzle, and thus does not show up in FIGS. 3A–3C. Nozzle thrust is predominantly directed rearwardly, but a sideward component of thrust is provided when the nozzle is angled to the left (FIG. 3A) or right (FIG. 3C).

Figure 3F:
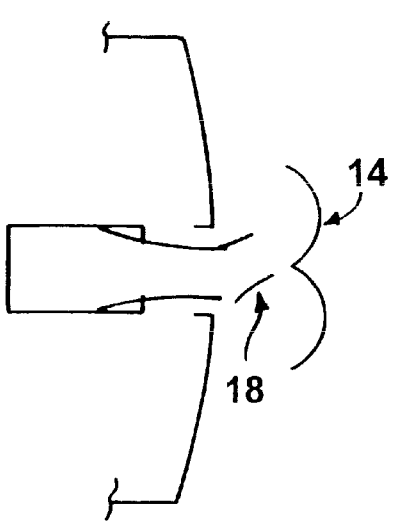
PRIOR ART FIG. 3F
Figure 3E:
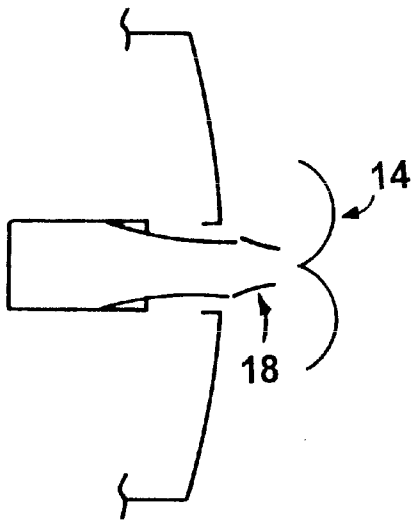
PRIOR ART FIG. 3E
Figure 3D:
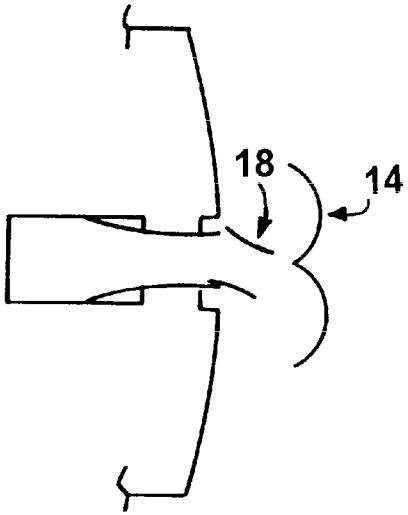
PRIOR ART FIG. 3D

FIGS. 3D–3F show the waterjet nozzle 18 in the same three angular positions for the case in which the reversing bucket is fully down. The bucket has the effect of reversing the dominant thrust direction, but the sideward component of thrust is approximately the same as if the bucket were all of the way up (e.g., the sideward component is approximately the same in FIGS. 3A and 3D, and in 3C and 3F).

Electrical and Hydraulic Components

Figure 4:
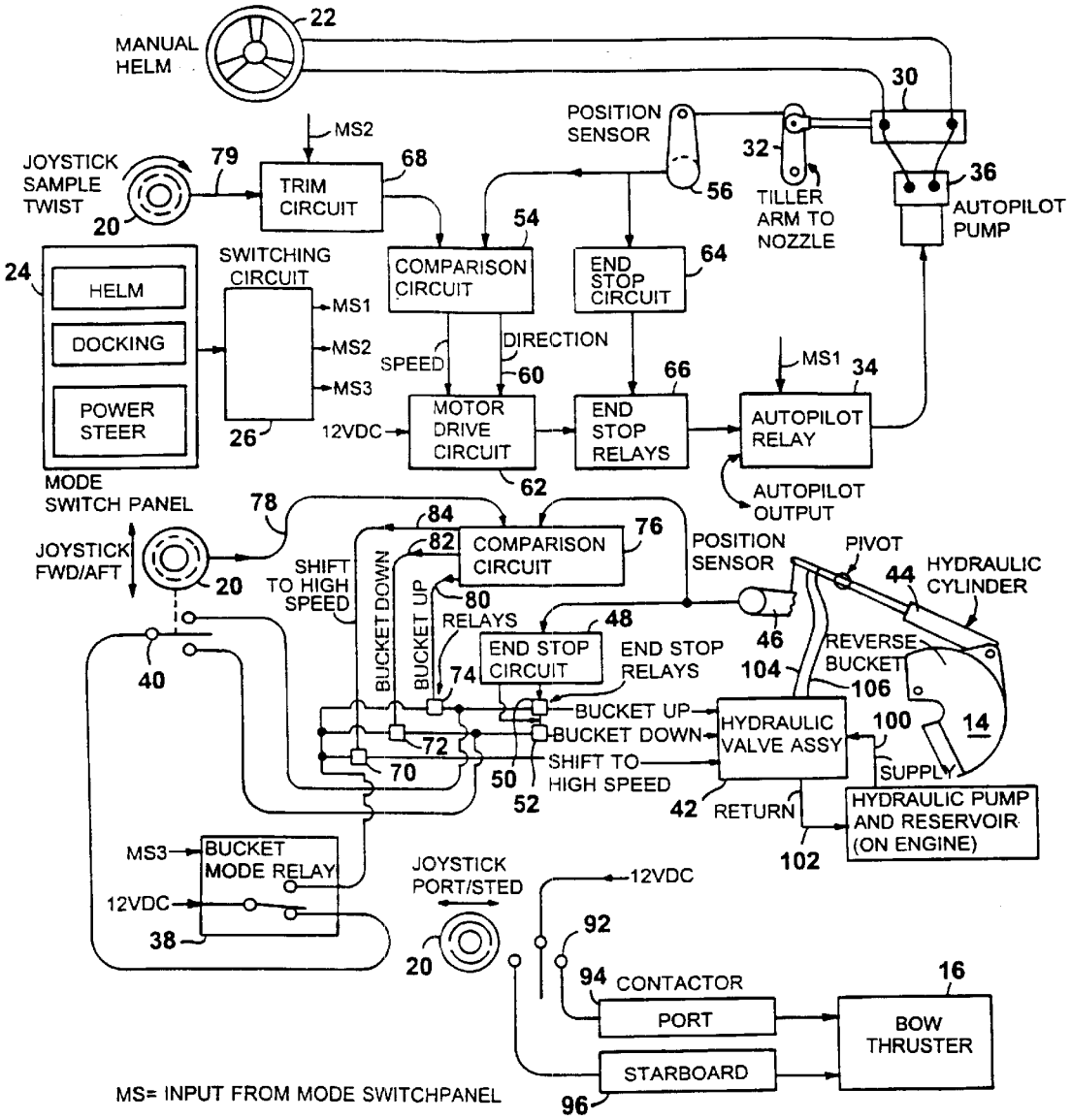
FIG. 4 is an overall electrical and hydraulic schematic of a preferred embodiment of the invention.

FIG. 4 shows the principal electrical and hydraulic components of a preferred embodiment. The figure is organized in three sections. The upper portion relates to control of the waterjet nozzle 18; the middle, to control of the reversing bucket 14; the lower, to control of the bowthruster 16. Operator control of the nozzle, bucket, and bowthruster is achieved using a joystick 20 and steering wheel 22. The joystick 20 has three independent directions of movement: rotating or twisting movement about a vertical axis, for control of the nozzle (upper section of FIG. 4); forward/aft movement, for control of the bucket (middle of FIG. 4); left/right (port/starboard) movement, for control of the bowthruster (bottom of FIG. 4). In each direction of movement, a centering force (or torque, in the case of rotation) returns the joystick to a neutral, centered position when it is released. The centering force is preferably provided by springs.

A mode selection switchpanel 24 is used by the operator to vary the relationship between movements of the joystick and movements of the nozzle and reversing bucket. The operator can select from among three modes: Helm, Docking, and Power Steer (using momentary, illuminated switches). Outputs from switchpanel 24 are fed to switching circuit 26, from which mode control outputs MS1, MS2, MS3 are fed to various components of the system. Other outputs (not shown) of the switching circuit perform various conventional functions, e.g., controlling indicator lights on the switchpanel. A row of 10 double-bright LEDs is also provided (not shown) as a rough indicator of bucket position. A sustained pushbutton switch is used to dim both switch lighting and the row of LEDs. A small trim knob is used to offset the center position of the nozzle in the Power Steer mode (it is connected to a 270 degree potentiometer).

The switching circuit is contained on a printed circuit board housed in an electronics enclosure. All other electrical components in the system connect to this board, including joystick, switchpanel 24, power supply leads, bowthruster contactors 94, 96 and autopilot output. A single sheathed cable leads aft from the electronics enclosure to hydraulic solenoid valves 88, 90 in the hydraulic valve assembly, and bucket and nozzle position sensors 46, 56. The circuit board supplies a regulated voltage to position sensors and joystick. It contains a logic section of diodes and relays to switch between modes, a set of comparison circuits 54, 76 to accomplish the follow-up action between joystick and the jet, adjustments for calibrating the follow-up circuit, power switching relays 50, 52, 70, 72, 74 to trigger the hydraulic solenoids 88, 90 and nozzle pump motor 36, electronic end stop circuits 48, 64 for bucket and nozzle travel, and a circuit for dimming the switchpanel display.

The hydraulic valve assembly is designed to mount near the jet, although it could be mounted at any point that allows plumbing between the hydraulic pump and bucket positioning cylinder. The primary components are a priority flow controller 86, solenoid cartridge valve 88 with one NO and one NC outlet, and a reversing solenoid valve 90 with spring return to tandem center. Also included on the plate is a junction box to connect solenoid valves, bucket and nozzle position sensors and autopilot/nozzle pump.

The position sensors are sealed 5K ohm, 360 degree potentiometers. These are preferably mounted so that they are in the middle of their travel at neutral bucket and nozzle, as this allows calibration of neutral bucket and neutral nozzle positions by simply loosening the position sensor brackets and rotating the sensors.

Operation

As noted earlier, three modes of operation are available, selected by pressing buttons on the switchpanel: Helm, Docking, and Power Steer. The primary difference between modes is the method of controlling bucket and nozzle. In all three modes the bowthruster is activated by deflecting the joystick left or right.

1. Helm Mode

Helm is the default mode, which the system is in when power is first supplied to the switching circuit 26. In Helm mode, the boat is steered solely by the steering wheel (in conjunction with the autopilot, if activated), and is the mode typically used underway when the boat operator prefers to steer with the wheel. Helm mode also serves as the failsafe mode in the event of a failure of the joystick or switching circuit. The steering wheel is connected hydraulically (in a conventional manner) to steering ram 30, which drives tiller arm 32, which, in turn, is mechanically coupled to the waterjet nozzle. In Helm mode, control output MS1 is low (i.e., zero volts), and thus autopilot relay 34 remains unactivated, with the result that autopilot output signals are passed to the autopilot pump 36, but inputs from the joystick and associated electronics are blocked.

In Helm mode the reversing bucket functions in a non-follow-up manner, i.e., forward or aft movement of the joystick functions as a simple up/down directional switch for movement of the bucket. Forward movement of the joystick causes the bucket to move upward as long as the joystick is held forward of center. Conversely, aft movement causes the bucket to move downwardly for as long as the joystick is held aft of center. When the joystick is at rest, i.e., in the neutral center position, the bucket remains at its current orientation. Thus, tapping the joystick forward or aft momentarily in Helm mode causes the bucket to move incrementally upward or downward by a small amount and then remain in that position.

In Helm mode control output MS3 is low, resulting in bucket mode relay 38 being in a position in which 12 VDC is supplied to joystick forward/aft switch 40. In this way, forward movement of the joystick has the effect of delivering a 12 VDC signal to the bucket up input line to hydraulic valve assembly 42, and aft movement has the opposite effect, namely, delivering a 12 VDC signal to the bucket down input line. The hydraulic valve assembly is connected to hydraulic cylinder 44, which drives the bucket 14. A bucket position sensor 46 provides an electrical signal indicative of the position of the reversing bucket. The position sensor signal is supplied to an end stop circuit 48, which determines whether the limits of upward or downward travel of the bucket have been exceeded, and, if so, activates the appropriate..end stop relay 50, 52, to prevent further movement of the bucket.

2. Docking Mode

Docking mode is the mode used for slow speed maneuvering, e.g., in approaching a dock or slip. In this mode, both bucket and nozzle are controlled by the joystick in a follow-up manner. Thus, moving the joystick to a position (e.g., halfway forward) causes the corresponding device (e.g., the bucket) to move to a corresponding position (e.g., halfway up).

In Docking mode, twisting of the joystick produces rotation of the nozzle. Twisting the joystick produces an output signal 79 that is compared by comparison circuit 54 to the output of position sensor 56, which measures the position of the nozzle. The comparison circuit produces speed and direction signals 58, 60, which control motor drive circuit 62, which, in turn, supplies a signal to autopilot pump 36. The result is that the nozzle moves until the output of position sensor 56 matches the joystick output signal. For example, if the joystick is twisted to the right from a neutral position, there is initially a large difference in voltage between the joystick output and the output of the tiller position signal. This produces a movement of the nozzle in a direction that causes the stern of the boat to move to port (left). As the nozzle turns, the output of the tiller position signal increases until a point is reached at which the amplitude of the position sensor signal matches that of the joystick signal, at which point movement of the nozzle ceases. To avoid the nozzle hunting back and forth once it reaches a desired position, the comparison circuit 54 uses pulse width modulation to drive the autopilot pump. When the nozzle is far away from the desired position, a continuous signal is delivered to the autopilot pump. When the nozzle gets within a predetermined proximity to the desired position, the continuous signal is replaced with a pulsed signal, which has the effect of slowing down movement of the nozzle. Control output MS1 is high in Docking mode, so that the autopilot relay blocks the autopilot output signal, and instead drives the autopilot pump with the output of the motor drive circuit. An end stop circuit 64 compares the output of position sensor 56 to a stored voltage corresponding to the ends of travel of the nozzle tiller arm 32, and activates end stop relays 66 in the event that the tiller arm reaches one or the other ends of its allowed travel. Trim circuit 68 is not active in Docking mode (MS2 is low).

Bucket control in Docking mode is also done in a follow-up manner. Control output MS3 controls bucket mode relay 38 so that 12 VDC is supplied not to joystick switch 40 (as in the case of Helm mode) but to relays 70, 72, 74, which control the outputs of comparison circuit 76. The switch function of the joystick is replaced with a forward/aft potentiometer output 78, which is compared to the output of position sensor 46 by comparison circuit 76. The comparison circuit produces three outputs, a bucket-up signal 80, a bucket-down signal 82, and a shift-to-high-speed signal 84. With relays 70, 72, 74 activated, these three signals are supplied to hydraulic valve assembly 42, to control movement of the bucket. The result is that the bucket moves until the output of the position sensor 46 matches the output 78 of the joystick. If, for example, the joystick is moved forward from neutral and held in that forward position, there would initially be a large difference between the joystick output 58 and the output of the position sensor. The comparison circuit would generate a bucket up signal causing the hydraulic valve assembly 42 to move hydraulic cylinder 14 in a direction that would move the bucket upwardly. As the bucket approached the upward position corresponding to the forward position of the joystick, the difference between the joystick and positions sensors signals would decrease, until finally movement of the bucket would cease.

Figure 5:
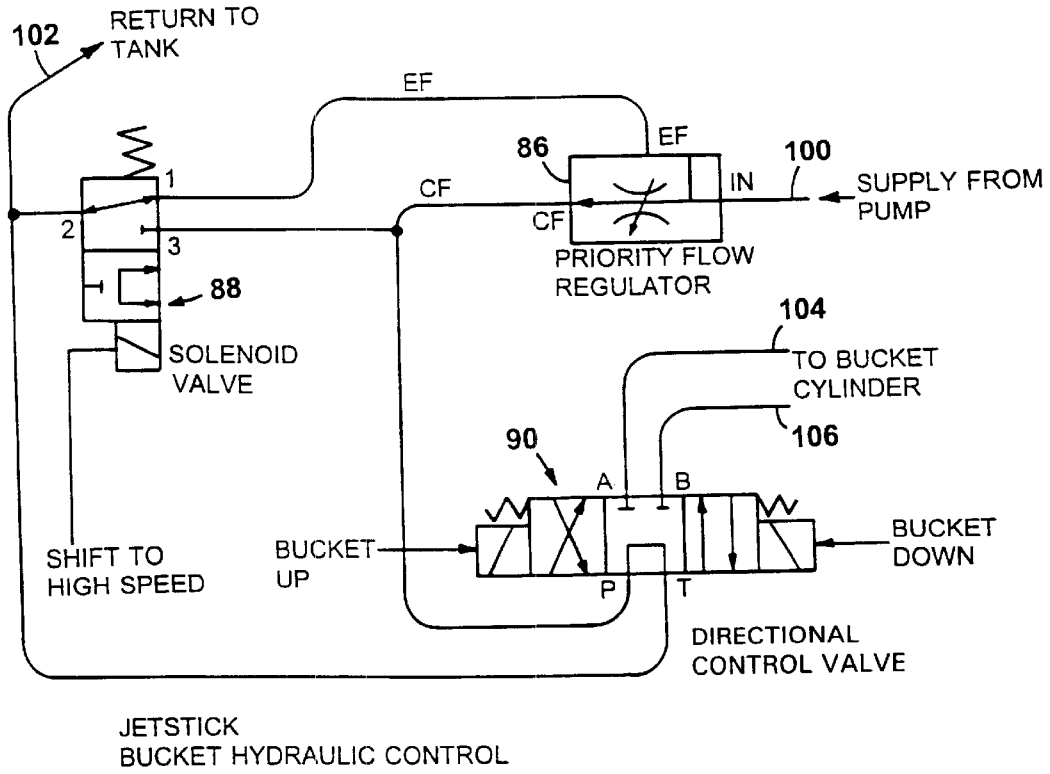
FIG. 5 is a schematic of the hydraulic valve assembly used to control the position of the reversing bucket of the preferred embodiment.

Hydraulic valve assembly 42 is capable of driving the bucket at two rates of speed, a high rate that is used when the bucket is far away from the position commanded by the joystick, and a low rate of speed when the bucket is near the desired position. This allows the bucket to be rapidly moved to a desired position, while also being brought to rest without the vibration and noise associated with stopping a fast moving hydraulic cylinder. The dual speed control is achieved using the hydraulic components shown in FIG. 5. There are four hydraulic connections to the valve assembly: supply 100 from the hydraulic pump, return 102 to the hydraulic reservoir tank, and connections 104, 106 to each side of the hydraulic cylinder 44. A reversing solenoid valve 90 governs the direction in which fluid is supplied to the cylinder. A bucket up signal drives the valve in one direction, and a bucket down signal drives the valve in the reverse direction. The rate of flow of hydraulic fluid through the solenoid valve is governed by a second valve 88, working in conjunction with a flow regulator 86. The regulator divides the incoming supply flow into a controlled flow output CF and an excess flow output EF. The controlled flow output CF is always delivered to the reversing solenoid valve 90, but when the shift-to-high-speed signal is supplied to valve 88, the excess flow output is combined with the controlled flow output, to increase the rate of flow. Solenoid valve 88 accomplishes this by moving from the position drawn in FIG. 5 (in which the excess flow output is returned to the reservoir) to a position in which the excess flow is connected to the controlled flow output. In that position, the excess flow EF is routed back to and summed with the controlled flow CF.

3. Power Steer Mode

The third mode of operation is the Power Steer mode, in which the boat operator steers underway using the joystick rather than the wheel. Bucket control is the same as in Helm mode, i.e., non-follow-up (the joystick works as a up/down switch to control the reversing bucket). Nozzle control is similar to Docking mode, except that a trim circuit 68 is activated by control output MS2. The trim circuit reduces the sensitivity of the joystick, so that the same degree of twist in Power Steer produces less nozzle movement than in Docking. Also, a trim potentiometer (not shown) on the control panel is activated, allowing the operator to adjust the nozzle position that corresponds to zero twist of the joystick. This allows the operator to make small adjustments to the boat's track, e.g., to compensate for the effect of crosswind or current (without requiring that the operator maintain a slight twist on the joystick).

The bowthruster 16 operates the same in all modes, but is only normally useful in the slow speed maneuvering associated with the Docking mode. Left/right (port/starboard) movements of the joystick activate switch 92, which delivers 12 VDC to either the port contactor 94 or the starboard contactor 96. When activated contactors 94, 96 connect high power to the bowthruster motor. Contactor 94 delivers high power of one polarity, and contactor 96 delivers high power in the opposite polarity. The result is that port deflection of the joystick produces bowthruster action causing movement of the bow to port, and starboard deflection, movement of the bow to starboard. It has been found that a small amount of deadband in the left/right movement of the joystick is preferable, so that small left/right movements, such as those unavoidably associated with forward/aft and twisting movements, do not inadvertently activate the bowthruster.

Other embodiments are within the scope of the following claims.

What is claimed is:

1. A boat of the type driven by a waterjet, the boat comprising at least one waterjet drive assembly, the assembly comprising a nozzle at the stern of the boat, the nozzle directing a flow of water generally along the longitudinal axis of the boat, the nozzle being capable of rotation about a generally vertical axis to provide left and right sideward forces on the stern, and a reversing bucket for reversing the direction of a variable amount of the flow of water emerging from the nozzle, the reversing bucket being adjustable from any of a plurality of forward thrust positions in which enough water remains unaffected by the reversing bucket that a net forward thrust is maintained, to a neutral thrust position in which a substantial fraction of the flow of water is reversed so that the net thrust of the water reversed and the water not reversed is approximately zero, to any of a plurality of reverse thrust positions in which enough water is reversed that a net reverse thrust is maintained;

a bow thruster for directing a sideward flow of water at the bow of the boat to provide left and right sideward forces on the bow;

an electrical control circuit for controlling the nozzle, reversing bucket, and bow thruster; and a joystick device connected electrically to the electrical control circuit, and comprising one or more elements configured to be operated by movements of one hand of an operator, the elements of the joystick device configured to move in response to direct force applied thereto by at least first, second, and third movements of the hand, and wherein the joystick device and electrical control circuit are configured so that the first movement of the hand controls the reversing bucket, the second movement of the hand controls the nozzle, and the third movement of the hand controls the bow thruster.

2. The boat of claim 1 wherein the one or more elements of the joystick device comprise a stick control member and the joystick device is configured so that at least some of the first, second, and third movements of the hand produce movements of the stick control member.

3. The boat of claim 2 wherein at least one of the movements of the stick control member is fore and aft movement of the stick control member.

4. The boat of claim 2 wherein at least one of the movements of the stick control member is left and right movement of the stick control member.

5. The boat of claim 2 wherein at least one of the movements of the stick control member is rotation of the stick control member.

6. The boat of claim 2 wherein one of the movements of the stick control member is fore and aft movement of the stick control member, and a second movement is left and right movement of the stick control member.

7. The boat of claim 2 wherein one of the movements of the stick control member is fore and aft movement of the stick control member, and a second is left and right movement of the stick control member, and a third is rotation of the stick control member.

8. The boat of claim 3, 6, or 7 wherein fore and aft movement of the stick control member controls the reversing bucket and thereby controls forward and reverse thrust on the boat.

9. The boat of claim 8 wherein the joystick device and electrical control circuit are configured to provide at least two modes of operation, a first mode in which a follow-up relationship exists between forward/aft movement of the stick control member, and up/down movement of the reversing bucket, and a second mode in which a non-follow-up relationship exists between forward/aft movement of the stick control member and up/down movement of the reversing bucket.

10. The boat of claim 1 wherein any of the movements of the hand may be movement of the thumb, finger, or fingers of the operator.

* * * * *